US008105047B2

(12) United States Patent
Ha

(10) Patent No.: US 8,105,047 B2
(45) Date of Patent: Jan. 31, 2012

(54) ELECTRIC HOME APPLIANCE HAVING DRAIN FUNCTION AND METHOD OF CONTROLLING THE SAME

(75) Inventor: Yo Chul Ha, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 511 days.

(21) Appl. No.: 12/000,332

(22) Filed: Dec. 11, 2007

(65) Prior Publication Data

US 2008/0163930 A1 Jul. 10, 2008

(30) Foreign Application Priority Data

Jan. 5, 2007 (KR) ..... 10-2007-0001438
Apr. 24, 2007 (KR) ..... 10-2007-0040062

(51) Int. Cl.
*F04B 49/02* (2006.01)
*D06F 35/00* (2006.01)

(52) U.S. Cl. ..... 417/12; 8/158

(58) Field of Classification Search ..... 417/36, 417/12, 53; 8/158; 68/12.19, 208
See application file for complete search history.

(56) References Cited

U.S. PATENT DOCUMENTS 5,361,439 A 11/1994 Malchow
5,762,080 A 6/1998 Edwards et al.
2003/0056300 A1 3/2003 Ruhl et al.
2004/0078902 A1 4/2004 McGill et al.

FOREIGN PATENT DOCUMENTS

| | | |
|---|---|---|
| CN | 2478536 | 2/2002 |
| DE | 38 21 727 | 1/1990 |
| JP | 61-162980 | 7/1986 |
| JP | 5-76687 | 3/1993 |
| JP | 6-54789 | 3/1994 |
| JP | 10-201990 | 8/1998 |
| JP | 2005-342318 | 12/2005 |

OTHER PUBLICATIONS

European Office Action and Search Report for corresponding application 07123669.9 mailed Jun. 3, 2008.
Chinese Office Action for corresponding application 200810001509.2; issued Nov. 6, 2009.
Chinese Office Action for corresponding Chinese Patent Application No. 200810001509.2 dated May 27, 2011, 11 pgs.

*Primary Examiner* — Devon C Kramer
*Assistant Examiner* — Bryan Lettman
(74) *Attorney, Agent, or Firm* — Staas & Halsey LLP

(57) ABSTRACT

A home appliance equipped with a drain function and a method of controlling the same are disclosed. A method of controlling a home appliance equipped with a drain apparatus includes switching ON/OFF the drain apparatus during a first time, switching on the drain apparatus during a second time after switching ON/OFF the drain apparatus, checking a variation of the water level according to a draining status, and controlling the drain apparatus based on the checked water-level variation result corresponding to the draining status.

12 Claims, 8 Drawing Sheets

PRIOR ART

PRIOR ART

ELECTRIC HOME APPLIANCE HAVING DRAIN FUNCTION AND METHOD OF CONTROLLING THE SAME

CROSS-REFERENCE TO RELATED APPLICATIONS

This application claims the benefit of Korean Patent Applications No. 2007-00001438 filed on Jan. 5, 2007 and No. 2007-0040062 filed on Apr. 24, 2007 in the Korean Intellectual Property Office, the disclosures of which are incorporated herein by reference.

BACKGROUND

1. Field

The present invention relates to an electric home appliance having a drain function and a method of controlling the same, and more particularly to an electric home appliance having a drain function to more effectively perform a drain operation, and a method for controlling the same.

2. Description of the Related Art

Generally, an electric home appliance having a drain function may be a washing machine to wash laundry, such as clothes and a dishwasher, to wash dishes. The washing machine includes a dehydration process after performing a washing process, or a drain process drain water of a water tub before entering the dehydration process after a rinsing process. The dishwasher includes the rinsing process after the washing process or drains the water during a drain time of the next rinsing process.

The above-mentioned electric home appliance equipped with the drain function includes a drain passage and a drain apparatus (e.g., a drain pump) to drain the water from the water tub, so that the drain operation is quickly and easily performed.

The drain operation of the above-mentioned electric home appliance including the drain apparatus will hereinafter be described. Referring to FIG. 1, if a drain pump is switched on according to a series of prescribed steps at operation 1, water is drained from the home appliance, so that a water level begins to be lowered. In this case, the lowering water-level is detected at operation 3, and it is determined whether a current water level reaches a predetermined water level (also called a reset water-level) indicating the drain completion at operation 5.

If the water level of the home appliance does not reach the predetermined water level indicating the drain completion, a controller of the home appliance returns to operation 1 to continuously switch on the drain pump, so that the drain operation is continuously performed until the drain operation is completed. If the water level of the home appliance reaches the predetermined water level indicating the drain completion, the controller switches off the drain pump to finish draining the water at operation 7.

As shown in FIG. 2, according to the conventional home appliance equipped with the drain function, if the drain process starts operating by an ON-status drain pump, the drain pump is continuously operated until a current water level reaches a drain-completion water level. This operation is hereinafter referred to as a continuous drain operation.

The above-mentioned continuous drain operation can be easily performed under general situations. However, if the draining water-level starts increasing according to installation conditions (e.g., a draining height) of the home appliance, the possibility of generating cavitation caused by an air space (or air gap) of a drain-pump housing and the increased water pressure of residual water increases. If the cavitation occurs, the conventional home appliance cannot substantially drain the water during a predetermined time although the drain pump is continuously operated, so that an operation time of the drain pump (i.e., a draining time) becomes longer.

SUMMARY

Therefore, it is an aspect of the embodiments to provide a home appliance capable of more easily performing a drain operation by minimizing an influence of cavitation during a draining time, and a method of controlling the same.

It is another aspect of the embodiments to provide a home appliance to minimize a time required to solve the cavitation by switching on/off a drain pump when a drain process begins, and a method of controlling the same.

It is yet another aspect of the embodiments to provide a home appliance to variably control the on/off duty of the drain pump according to individual steps, so that the appliance can properly cope with a variation condition of the cavitation, and a method of controlling the same.

Additional aspects and/or advantages will be set forth in part in the description which follows and, in part, will be obvious from the description, or may be learned by practice of the invention.

In accordance with an embodiment, the above and/or other aspects can be achieved by the provision of a method of controlling a home appliance equipped with a drain apparatus including: switching ON/OFF the drain apparatus during a predetermined time; and continuously switching on the drain apparatus after the switching ON/OFF the drain apparatus, and performing a drain operation.

The predetermined switching ON/OFF control time of the drain apparatus may be determined by a predetermined duty ratio.

The predetermined time may be a sum of ON and OFF times of the drain apparatus, and may be equal to or less than about 10 seconds.

The ON time of the drain apparatus may not be shorter than the OFF time of the drain apparatus.

The method may further includes: detecting a changing water-level of water contained in the home appliance during the drain operation; and switching off the drain apparatus and terminating the drain operation when the detected water level reaches a drain-completion water level.

The foregoing and/or other aspects are achieved by providing a method of controlling a home appliance equipped with a drain apparatus including: switching ON/OFF the drain apparatus during a first time; switching on the drain apparatus during a second time after the switching ON/OFF the drain apparatus, and checking a variation of a water level according to a draining status; and controlling the drain apparatus based on the checked water-level variation result corresponding to the draining status.

The first time may not be less than or equal to the second time.

ON/OFF control times of the drain apparatus may be variably controlled based on the checked water-level variation result corresponding to the draining status.

The first time may be a sum of ON and OFF times of the drain apparatus, and may be variably controlled based on the checked water-level variation result corresponding to the draining status.

The method may further include: continuously switching on the drain apparatus to continuously conduct a normal drain operation when a normal drain operation is determined when the variation of the water level is checked according to the draining status.

The method may further include: variably controlling ON/OFF times of the drain apparatus when a normal drain operation is not determined when the variation of the water level is checked according to the draining status.

The foregoing and/or other aspects are achieved by providing a home appliance equipped with a drain function including: a drain apparatus; and a controller switching ON/OFF the drain apparatus during a predetermined time, continuously switching on the drain apparatus after switching ON/OFF the drain apparatus, and performing a drain operation.

The drain apparatus may include: a drain pump draining water from the home appliance to outside; and a check valve mounted to one side of the drain pump and preventing residual water of the drain pump from flowing backward.

The controller may switch ON/OFF the drain apparatus during a predetermined time when a drain operation begins, so that the controller solves cavitation in which residual water of the drain pump is not drained to the outside by inner air of the drain pump due to a water pressure of the residual water.

The controller may determine ON/OFF times of the drain apparatus according to a predetermined duty ratio.

The home appliance may further include: a water-level detector detecting a changing water level of water contained in the home appliance during the drain operation, wherein the controller switches off the drain apparatus when the detected water level reaches a drain-completion water level, so that the controller terminates the drain operation.

The foregoing and/or other aspects are achieved by providing a home appliance equipped with a drain function including: a drain apparatus; and a controller switching ON/OFF the drain apparatus during a first time, switching ON the drain apparatus during a second time, checking a variation of the water level according to a draining status, and controlling operations of the drain apparatus based on the checked variation of the water level.

The controller may determine the first time to be equal to or less than the second time.

The drain apparatus may include: a drain pump draining water from the home appliance to outside; and a check valve mounted to one side of the drain pump and preventing residual water of the drain pump from flowing backward.

The controller may switch ON/OFF the drain apparatus during the first time when a drain operation begins, so that the controller solves cavitation in which the residual water of the drain pump is not drained to outside by inner air of the drain pump due to a water pressure of the residual water.

The controller may variably control an ON/OFF duty ratio of the drain apparatus according to individual steps by referring to the checked water-level variation result.

The foregoing and/or other aspects are achieved by providing a method of controlling a home appliance equipped with a drain apparatus including a drain pump, the method including: switching ON the drain apparatus until a determination is made that inner air of the drain pump has been discharged; switching OFF the drain apparatus for a predetermined time after the switching ON the drain apparatus and after it is determined that the inner air of the drain pump has been discharged; and switching ON the drain apparatus after the switching OFF the drain apparatus for a predetermined time.

The method may further include detecting a water level after the switching ON the drain apparatus after the switching OFF the drain apparatus for a predetermined time; and switching OFF the drain apparatus when the water level is detected to be at a drain completion water level.

The method may further include detecting a water level after the switching ON the drain apparatus after the switching OFF the drain apparatus for a predetermined time; and continuously conducting the drain-ON operation until the water level is detected to be at a drain completion water level.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION OF THE EMBODIMENTS

Figure 1:
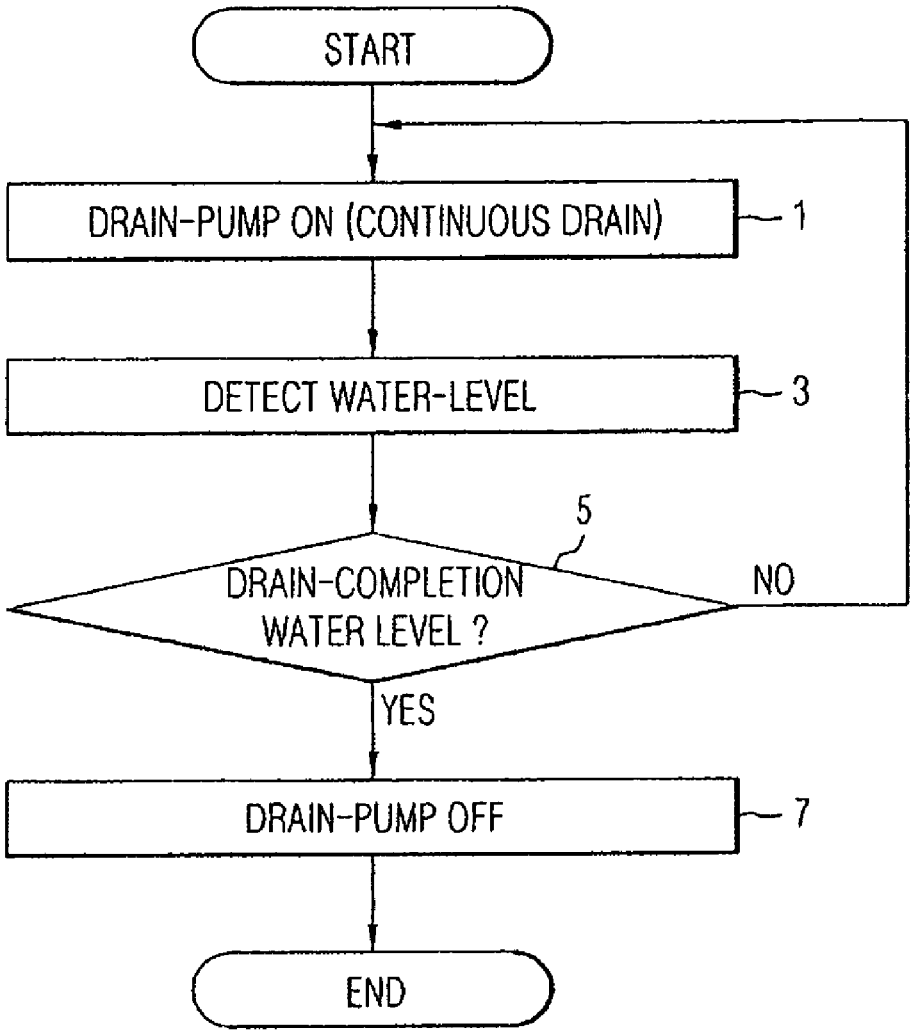
FIG. 1 is a flow chart illustrating a drain operation of a conventional home appliance equipped with a drain function.

Reference will now be made in detail to the embodiments, examples of which are illustrated in the accompanying drawings, wherein like reference numerals refer to like elements throughout. The embodiments are described below to explain the present invention by referring to the figures.

Figure 3:
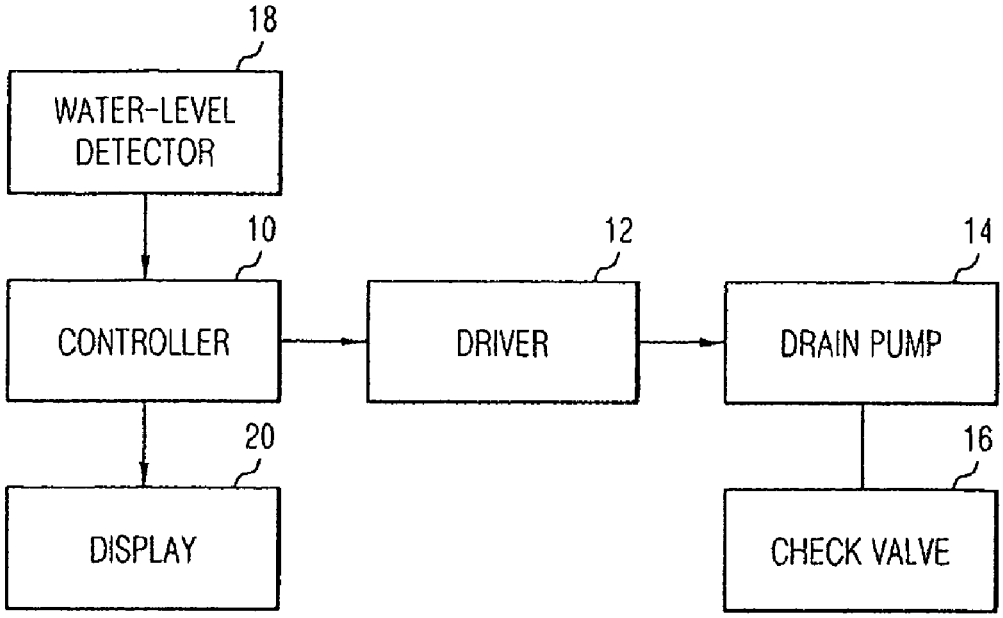
FIG. 3 is a block diagram illustrating a home appliance equipped with a drain function according to the present embodiments.

FIG. 3 is a block diagram illustrating a home appliance equipped with a drain function according to the present embodiments.

Referring to FIG. 3, the home appliance equipped with a drain function includes a controller 10, a driver 12, a drain pump 14, a check valve 16, a water-level detector 18, and a display 20.

The controller 10 is implemented with a microprocessor to control overall operations of the home appliance equipped with the drain function. The controller 10 switches on or off the drain pump 14 according to a series of steps when the drain process begins, minimizes cavitation, so that the controller 10 can easily perform the drain process. The controller 10 variably controls an on/off duty of the drain pump 14 according to individual steps, so that the controller 10 can properly control the drain operation according to a variation condition of the cavitation.

The driver 12 switches on or off the drain pump 14 to drain the water from the water tub according to a control signal of the controller 10.

The drain pump 14 drains the water from the water tub. For example, a well-known driving generator, such as a motor, capable of generating a driving power is used as the drain pump 14. The check valve 16 may be mounted to one side of the drain pump 14 to prevent residual water of the drain pump from flowing backward, after draining the water by the operation of the drain pump 14. The check valve 16 is open by a water pressure by the operation of the drain pump 14, so that the water is directed to the outside.

Generally, the drain apparatus includes the drain pump 14 and the check valve 16.

The water-level detector 18 detects a water level of the home appliance to determine whether a current water level reaches a drain-completion water level during the drain operation executed by switching on/off the drain pump 14. If the drain operation is not completed within a predetermined drain time by a control signal of the controller 10, the display 20 displays a faulty drain operation.

The above-mentioned home appliance equipped with the drain and a method of controlling the same will hereinafter be described in detail.

Figure 4:
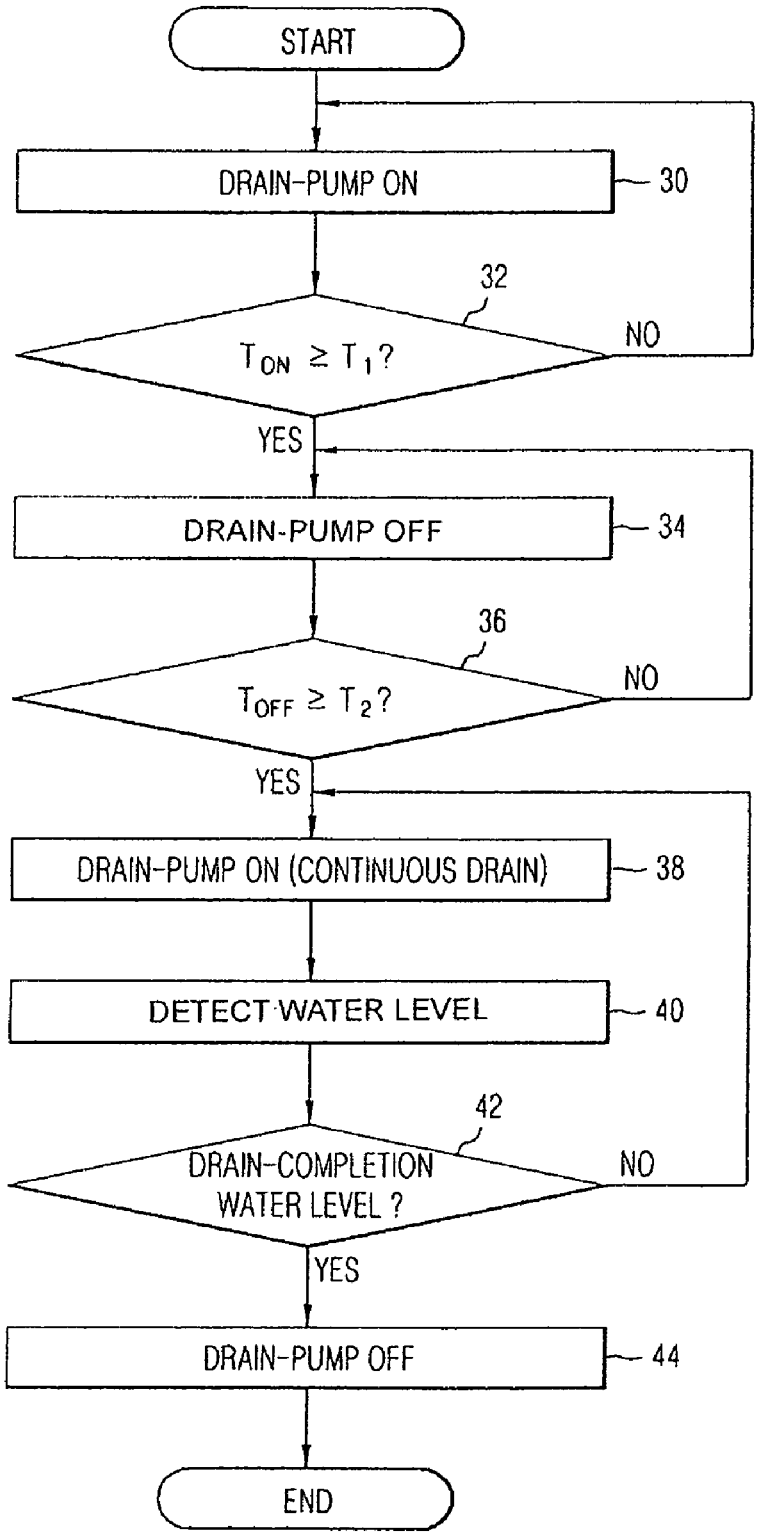
FIG. 4 is a flow chart illustrating a drain operation of the home appliance equipped with a drain function according to a first embodiment.

FIG. 4 is a flow chart illustrating a drain operation of the home appliance equipped with a drain function according to a first embodiment. FIG. 4 shows operations of a cavitation-solving interval to solve the cavitation before entering the continuous drain period executed by a continuous ON operation of the drain pump 14.

If the home appliance enters the drain process according to a series of operations, the controller 10 switches on the drain pump 14 via the driver 12 at operation 30.

If the drain pump is switched on, the water of the home appliance flows in the drain pump 14. The check valve 16 mounted to one side of the drain pump 14 is instantaneously open according to a water pressure of the water flowing in the drain pump 14, so that a drain passage is open. The air contained in the drain pump 14 is discharged to the outside, so that the air gap contained in the housing of the drain pump 14 is removed.

In this case, the controller 10 counts the ON time $T_{ON}$ of the drain pump 14, and determines whether the counted ON time $T_{ON}$ of the drain pump 14 is equal to or longer than a first setup time T1 of about 3 seconds, for example, capable of discharging inner air of the drain pump at operation 32. In this case, the first setup time T1 of about 3 seconds, for example, is used to discharge the inner air of the drain pump. If the ON time $T_{ON}$ of the drain pump 14 is shorter than the first setup time T1, the drain pump 14 is continuously switched on until the ON time $T_{ON}$ of the drain pump 14 reaches the first setup time T1.

If the ON time $T_{ON}$ of the drain pump 14 is equal to or longer than the first setup time T1, the controller 10 determines that the inner air of the drain pump 14 has been discharged, so that the controller 10 switches off the drain pump 14 using the driver 12 at operation 34.

If the drain pump 14 is switched off, the check valve 16 is closed by a water pressure of residual water of the drain pump, so that there is no air gap in the housing of the drain pump 14.

In this case, the controller 10 counts the OFF time $T_{OFF}$ of the drain pump 14, and determines whether the counted OFF time $T_{OFF}$ is equal to or longer than a second setup time T2 of about 2 seconds, for example, at operation 36. In this case, the second setup time T2 of about 3 seconds, for example, is used to minimize the cavitation after draining the air from the drain pump. If the OFF time $T_{OFF}$ of the drain pump 14 is shorter than the second setup time T2, the drain pump 14 is continuously switched off until the OFF time $T_{OFF}$ of the drain pump 14 reaches the second setup time T2.

If the OFF time $T_{OFF}$ of the drain pump 14 is equal to or longer than the second setup time T2, the controller 10 determines that the cavitation has been solved, so that the controller 10 switches on the drain pump 14 using the driver 12 at operation 38.

If the drain pump 14 is switched on, the water contained in the home appliance is discharged to the outside in the same manner as in a general drain operation, and the water level of the home appliance becomes lowered. In this case, the lowering water-level can be detected by the water-level detector at operation 40.

The controller 10 determines whether the water level detected by the water-level detector 18 reaches a predetermined water-level indicating a drain-completion time at operation 42. If the water level detected by the water-level detector 18 does not reach the aforementioned drain-completion water level, the controller 10 returns to operation 38 to continuously switch on the drain pump 14, and conducts the continuous drain operation until the water is fully drained. If the current water-level reaches a drain-completion water level, the drain pump 14 is switched off, so that the drain operation is terminated at operation 44.

The timing diagram of the above-mentioned drain operation of the home appliance will hereinafter be described with reference to FIG. 5.

Figure 5:
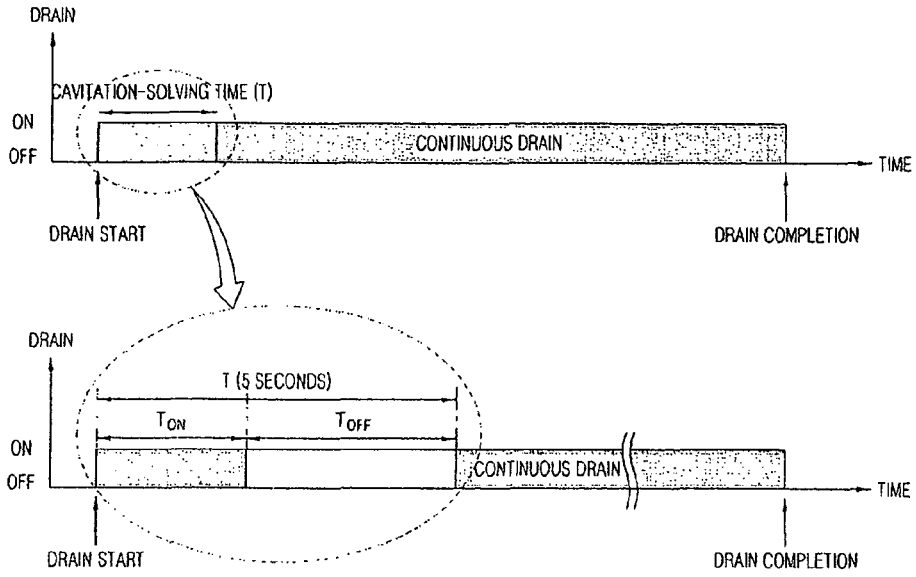
FIG. 5 is a timing diagram of the home appliance equipped with the drain function according to the first embodiment.

FIG. 5 is a timing diagram of a home appliance equipped with a drain function according to a first embodiment. The drain time of the home appliance according to the present embodiment includes a cavitation-solving interval and a continuous drain interval. The cavitation-solving interval is used to remove the air gap of the drain pump 14 by switching on/off the drain pump 14 when the drain operation begins. The continuous drain interval is used to drain the water from the home appliance by the continuous operation of the drain pump 14.

Figure 2:
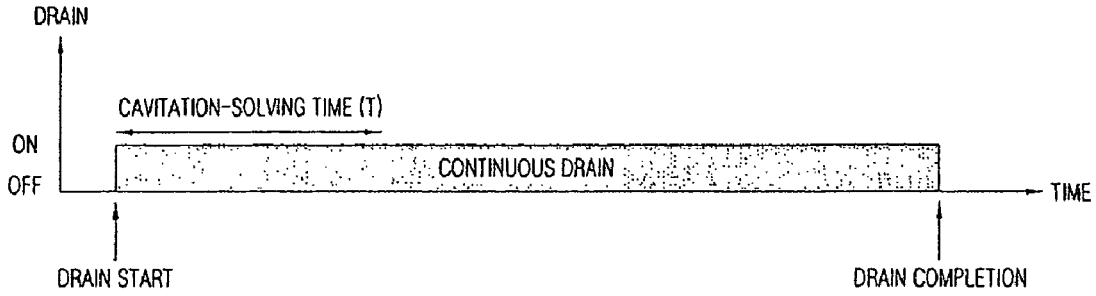
FIG. 2 is a timing diagram illustrating a drain operation of the conventional home appliance equipped with the drain function.

As can be seen from FIG. 5, the cavitation-solving interval T is the sum of the ON and OFF times $T_{ON}$ and $T_{OFF}$ of the drain pump 14. The ON time $T_{ON}$ and the OFF time $T_{OFF}$ are decided by a predetermined duty ratio. The cavitation-solving interval is set to a maximum of 10 seconds, for example, and is shorter than the conventional cavitation-solving time shown in FIG. 2.

Although FIGS. 4 and 5 have disclosed a drain operation capable of solving the cavitation by determining the ON/OFF times of the drain pump 14 according to a predetermined duty ratio, other improved drain operations will hereinafter be described with reference to FIGS. 6 to 8. If the condition capable of encountering the cavitation is changed to another according to installation conditions or residual-water situations of the home appliance, the above-mentioned improved drain operations of FIGS. 6-8 variably set the ON/OFF times of the drain pump 14 according to a draining status to properly cope with the variation conditions of the cavitation.

Figure 6:
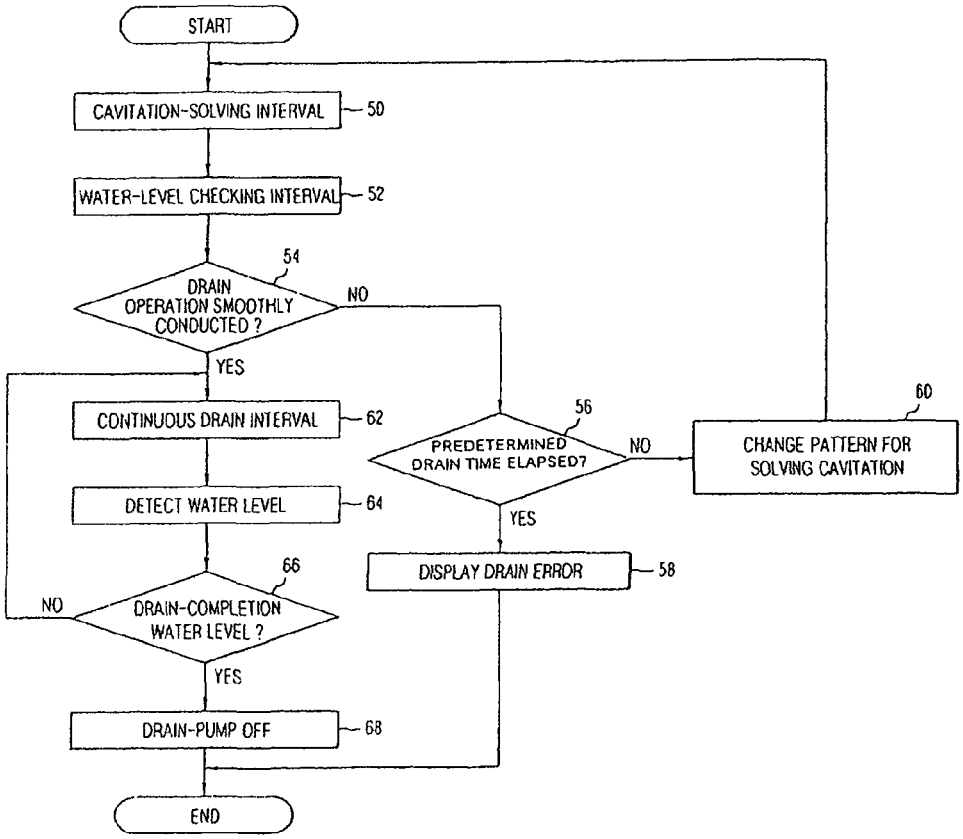
FIG. 6 is a flow chart illustrating a drain operation of a home appliance equipped with a drain function according to a second embodiment.

FIG. 6 is a flow chart illustrating a drain operation of a home appliance equipped with a drain function according to a second embodiment.

Referring to FIG. 6, if the home appliance equipped with a drain function enters the drain process according to a series of steps, the controller 10 conducts the cavitation-solving interval of the pattern 1 in order to variably control the ON/OFF duty of the drain pump 14 according to individual steps at operation 50. Then, the controller 10 conducts a water-level checking interval to check the actual draining status after the cavitation has been solved at operation 52.

The controller 10 determines whether the drain operation is being smoothly conducted during the water-level checking interval at operation 54. If the drain operation is not being smoothly conducted, the controller 10 determines whether a predetermined drain time indicating a maximum time capable of draining the water from the home appliance elapses at operation 56.

If the drain time elapses at operation 56, the controller 10 determines that the drain operation has not been completed within a predetermined time, and displays a faulty drain operation on the display 20 at operation 58.

If the drain time does not elapse at operation 56, the controller 10 changes a current pattern of solving the cavitation to the next pattern (Pattern 2) at operation 60, and then returns to operation 50.

If the drain operation is being smoothly conducted at operation 54, the controller 10 conducts the continuous drain interval to continuously switch on the drain pump 14 at operation 62. Thereafter, the changing inner water level of the home appliance is detected by the water-level detector 18 at operation 64.

The controller 10 determines whether the current water level detected by the water-level detector 18 reaches the drain-completion water level at operation 66. If the current water level does not reach the drain-completion water level, the controller 10 returns to operation 62 to continuously switch on the drain pump 14. The controller 10 conducts the continuous drain operation until the drain operation is completed. If the current water level reaches the drain-completion water level, the controller 10 switches off the drain pump 14, so that the drain operation is completed at operation 68.

Figure 7:
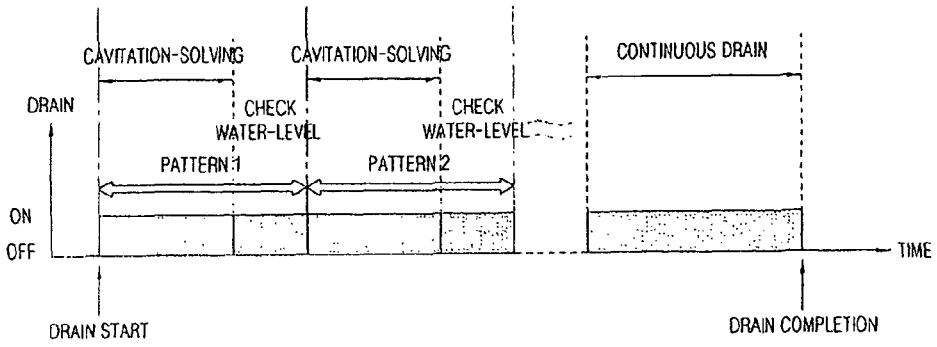
FIG. 7 is a timing diagram illustrating the drain operation of the home appliance equipped with the drain function according to the second embodiment.
Figure 8:
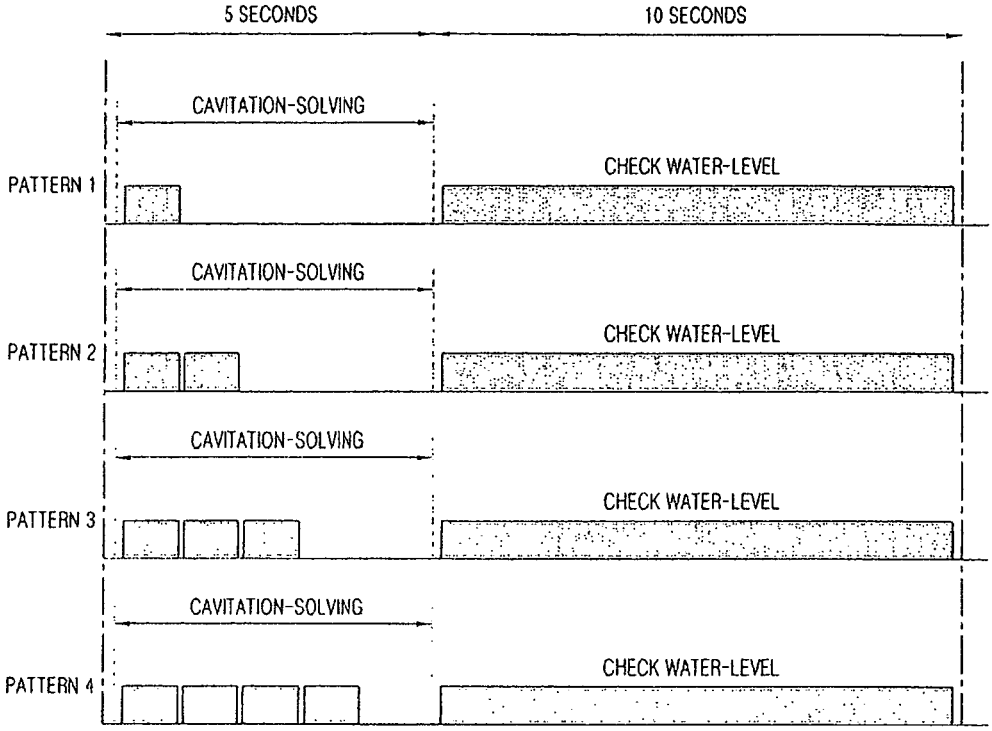
FIG. 8 is a timing diagram illustrating detailed drain operations of individual patterns to solve cavitation of FIG. 7 according to the present embodiments.

The timing diagram of the above-mentioned drain operation of the home appliance is shown in FIGS. 7 and 8.

FIG. 7 is a timing diagram illustrating the drain operation of the home appliance equipped with the drain function according to the second embodiment.

The drain time of the home appliance according to the second embodiment includes a cavitation-solving interval, a water-level checking interval, and a continuous draining interval. During the cavitation-solving interval, the controller 10 variably controls the on/off duty ratio of the drain pump 14 according to individual operations when the drain operation begins, so that the controller 10 can properly cope with a variation condition of the cavitation. During the water-level checking interval, the controller 10 checks a substantial draining status after the cavitation has been solved. During the continuous draining interval, the water is drained from the home appliance by the continuous operation of the drain pump 14.

The cavitation-solving interval is composed of a plurality of patterns (Patterns 1-4) capable of operating the drain pump 14 with a variable duty ratio. During the cavitation-solving interval, the above four patterns are sequentially repeated (in the order of Pattern 1→Pattern 2→Pattern 3→Pattern 4→Pattern 1→ . . . ) until the drain operation is smoothly conducted. A detailed description thereof will hereinafter be described with reference to FIG. 8.

FIG. 8 is a timing diagram illustrating detailed drain operations of individual patterns to solve cavitation of FIG. 7 according to a present embodiment.

Referring to FIG. 8, the Pattern 1 includes a cavitation-solving interval of 5 seconds and a water-level checking interval of 10 seconds. In more detail, in order to perform the Pattern 1, the controller 10 goes to the cavitation-solving interval of 5 seconds, so that the controller 10 solves the cavitation upon receiving a control signal from the drain pump 14 having a duty ratio composed of the ON time of 1 second and the OFF time of 4 seconds. Thereafter, the controller 10 goes to the water-level checking interval of 10 seconds, so that the controller 10 continuously switches on the drain pump 14 for 10 seconds to conduct the drain operation, and determines whether the drain operation is being smoothly conducted. If the drain operation is being smoothly conducted, the controller 10 goes to the continuous draining interval. If the drain operation is not being smoothly conducted, the controller 10 goes to the Pattern 2.

The Pattern 2 includes a cavitation-solving interval of 5 seconds and a water-level checking interval of 10 seconds. In more detail, in order to perform the Pattern 2, the controller 10 goes to the cavitation-solving interval of 5 seconds, so that the controller 10 solves the cavitation upon receiving a control signal from the drain pump 14 having a duty ratio composed of the ON time of 2 seconds and the OFF time of 3 seconds. Thereafter, the controller 10 goes to the water-level checking interval of 10 seconds, so that the controller 10 continuously switches on the drain pump 14 for 10 seconds to conduct the drain operation, and determines whether the drain operation is being smoothly conducted. If the drain operation is being smoothly conducted, the controller 10 goes to the continuous draining interval. If the drain operation is not being smoothly conducted, the controller 10 goes to the Pattern 3.

The Pattern 3 includes a cavitation-solving interval of 5 seconds and a water-level checking interval of 10 seconds. In more detail, in order to perform the Pattern 3, the controller 10 goes to the cavitation-solving interval of 5 seconds, so that the controller 10 solves the cavitation upon receiving a control signal from the drain pump 14 having a duty ratio composed of the ON time of 3 seconds and the OFF time of 2 seconds. Thereafter, the controller 10 goes to the water-level checking interval of 10 seconds, so that the controller 10 continuously switches on the drain pump 14 for 10 seconds to conduct the drain operation, and determines whether the drain operation is being smoothly conducted. If the drain operation is being smoothly conducted, the controller 10 goes to the continuous draining interval. If the drain operation is not being smoothly conducted, the controller 10 goes to the Pattern 4.

The Pattern 4 includes a cavitation-solving interval of 5 seconds and a water-level checking interval of 10 seconds. In more detail, in order to perform the Pattern 4, the controller 10 goes to the cavitation-solving interval of 5 seconds, so that the controller 10 solves the cavitation upon receiving a control signal from the drain pump 14 having a duty ratio composed of the ON time of 4 seconds and the OFF time of 1 second. Thereafter, the controller 10 goes to the water-level checking interval of 10 seconds, so that the controller 10 continuously switches on the drain pump 14 for 10 seconds to conduct the drain operation, and determines whether the drain operation is being smoothly conducted. If the drain operation is being smoothly conducted, the controller 10 goes to the continuous draining interval. If the drain operation is not being smoothly conducted, the controller 10 returns to the Pattern 1.

In this way, the home appliance according to the present embodiments variably adjusts the ON/OFF duty ratio of the drain pump 14 in consideration of several installation conditions by means of four patterns (Patterns 1~4), so that the controller can properly cope with the variation conditions of the cavitation until the drain operation is smoothly conducted, and the drain operation is more effectively conducted.

Although the present embodiments have disclosed only four patterns of varying the ON/OFF duty ratio of the drain pump 14, the scope and spirit of the present embodiments are not limited to the four patterns, and the on/off duty condition become more diverse, so that the effectively draining algorithm for the home appliance can be implemented.

Although the present embodiments have assumed that the cavitation-solving interval is about 5 seconds and the water-level checking interval is about 10 seconds, the scope and spirit of the present embodiments are not limited to the above-mentioned examples, and can also be applied to other examples. Needless to say, the effective draining algorithm for the home appliance can also be implemented.

As is apparent from the above description, the home appliance according to the present embodiments can smoothly perform a drain operation by minimizing the influence of cavitation during a draining time, so that the draining time is shorter than a conventional draining time by 10 seconds or more.

The home appliance minimizes a time required to solve the cavitation by switching on/off a drain pump when a drain process begins, and removes the possibility of generating the faulty draining operation. The home appliance prevents the drain pump from being unnecessarily operated, resulting in an increased throughput.

The home appliance variably controls the on/off duty of the drain pump according to individual steps, so that the home appliance can properly cope with a variation condition of the cavitation.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of controlling a home appliance equipped with a drain apparatus, the method comprising:

switching ON the drain apparatus for at least a first interval and switching OFF the drain apparatus for at least a second interval to minimize an influence of cavitation during a drain operation, the at least first and second intervals cumulatively being a predetermined time during only the drain operation of the home appliance; and continuously switching ON the drain apparatus after the switching ON and OFF of the drain apparatus during the predetermined time, and performing a remainder of the drain operation without switching off the drain apparatus until the drain operation is complete.

2. The method according to claim 1, wherein the first and second intervals are determined by a predetermined duty ratio.

3. The method according to claim 1, wherein the predetermined time is equal to or less than about 10 seconds.

4. The method according to claim 3, wherein the at least a first interval of the drain apparatus is not shorter than the at least a second interval of the drain apparatus.

5. The method according to claim 1, further comprising:

detecting a changing water-level of water contained in the home appliance during the drain operation; and switching off the drain apparatus and terminating the drain operation when the detected water level reaches a drain-completion water level.

6. A method of controlling a home appliance equipped with a drain apparatus, the method comprising:

switching ON the drain apparatus for at least a first interval and switching OFF the drain apparatus for at least a second interval, the at least first and second intervals cumulatively being a first time during only a drain operation of the home appliance;

switching ON the drain apparatus during a second time during only a drain operation of the home appliance after the switching ON and OFF of the drain apparatus during the first time, and checking a variation of a water level according to a draining status; and variably controlling the first and second intervals of the drain apparatus based on the result of the checking of the variation of the water level according to the draining status, wherein the drain apparatus is not switched off during the second time until the drain operation is complete.

7. The method according to claim 6, wherein the first time is less than or equal to the second time.

8. The method according to claim 6, further comprising:

continuously switching on the drain apparatus after the first time to continuously conduct a normal drain operation when the normal drain operation is determined from the checking of the variation of the water level according to the draining status.

9. The method according to claim 6, further comprising:

variably controlling the first and second intervals of the drain apparatus when a normal drain operation is not determined from the checking of the variation of the water level according to the draining status.

10. A method of controlling a home appliance equipped with a drain apparatus including a drain pump, the method comprising:

switching ON the drain apparatus until a determination is made that inner air of the drain pump has been discharged;

switching OFF the drain apparatus for a predetermined time after the switching ON the drain apparatus and after it is determined that the inner air of the drain pump has been discharged; and switching ON the drain apparatus after the switching OFF of the drain apparatus during the predetermined time until a drain operation of the drain apparatus is complete and then switching OFF the drain apparatus, wherein the switching ON until the determination is made, the switching OFF during the predetermined time and the switching ON after the predetermined time is performed during only the draining operation to minimize the influence of cavitation.

11. The method according to claim 10, further comprising:

detecting a water level after the switching ON the drain apparatus after the switching OFF the drain apparatus during the predetermined time; and determining that the drain operation is complete when the water level is detected to be at a drain completion water level.

12. The method according to claim 10, further comprising:

detecting a water level after the switching ON the drain apparatus after the switching OFF the drain apparatus during the predetermined time; and continuously conducting the drain-ON operation without switching OFF the drain apparatus until the water level is detected to be at a drain completion water level.

* * * * *